US012782046B2

(12) United States Patent
Klein et al.

(10) Patent No.: US 12,782,046 B2
(45) Date of Patent: Nov. 3, 2026

(54) CRYOGENIC AIR RECTIFICATION SYSTEM, CONTROL UNIT, AIR SEPARATION UNIT AND METHOD OF CRYOGENICALLY SEPARATING AIR

(71) Applicant: LINDE GMBH, Pullach (DE)

(72) Inventors: Harald Klein, Munich (DE); Michael Siebel, Pullach (DE); Dimitri Golubev, Pullach (DE); Bernd Wunderlich, Pullach (DE); Martin Pottmann, Pullach (DE); Robert Kender, Pullach (DE)

(73) Assignee: Linde GmbH, Pullach (DE)

( * ) Notice: Subject to any disclaimer, the term of this patent is extended or adjusted under 35 U.S.C. 154(b) by 219 days.

(21) Appl. No.: 18/837,765

(22) PCT Filed: Jan. 24, 2023

(86) PCT No.: PCT/EP2023/025033

§ 371 (c)(1),
(2) Date: Aug. 12, 2024

(87) PCT Pub. No.: WO2023/156061

PCT Pub. Date: Aug. 24, 2023

(65) Prior Publication Data

US 2025/0146746 A1 May 8, 2025

(30) Foreign Application Priority Data

Feb. 17, 2022 (EP) ..... 22020062

(51) Int. Cl.
*F25J 3/04* (2006.01)

(52) U.S. Cl.
CPC ..... *F25J 3/04848* (2013.01); *F25J 3/04412* (2013.01); *F25J 3/04709* (2013.01);
(Continued)

(58) Field of Classification Search
CPC .. F25J 2200/06; F25J 2200/34; F25J 2200/54; F25J 2200/72; F25J 2215/42;
(Continued)

(56) References Cited

U.S. PATENT DOCUMENTS 5,355,681 A * 10/1994 Xu ..... F25J 3/04672 62/646
6,240,744 B1 * 6/2001 Agrawal ..... F25J 3/04733 62/643
6,269,659 B1 * 8/2001 De Bussy ..... F25J 3/04303 62/648
6,708,523 B2 * 3/2004 Lochner ..... F25J 3/04412 62/649

(Continued)

FOREIGN PATENT DOCUMENTS

DE 10 2020 000 464 A1 7/2021
EP 1 522 808 A1 4/2005
EP 1 287 302 B1 9/2005

OTHER PUBLICATIONS

H.-W. Haring (ed.), Industrial Gases Processing, Wiley-VCH, 2006, especially section 2.2.5, "Cryogenic Rectification".

(Continued)

*Primary Examiner* — Filip Zec
(74) *Attorney, Agent, or Firm* — Millen, White, Zelano & Branigan, PC; Brion P. Heaney

(57) ABSTRACT

A cryogenic air rectification system comprising a high pressure column, a low pressure column and an argon removal unit coupled to a condenser evaporator, wherein the system is configured to pass gas from a position above an oxygen section of the low pressure column as an argon removal feed gas to a lower region of the argon removal unit, wherein the system is configured to condense gas from an upper region of the argon removal unit in the condenser evaporator to form a condensate, wherein the system is configured to pass further gas from the top of the upper region of the argon removal unit out of the system, and (Continued)

wherein the system is configured to pass at least a part of the condensate as a reflux to the upper region of the argon removal unit.

19 Claims, 12 Drawing Sheets

(52) U.S. Cl.
CPC ..... *F25J 2200/06* (2013.01); *F25J 2200/34* (2013.01); *F25J 2200/72* (2013.01); *F25J 2215/42* (2013.01); *F25J 2215/50* (2013.01); *F25J 2215/58* (2013.01); *F25J 2280/50* (2013.01)

(58) Field of Classification Search
CPC .. F25J 2215/50; F25J 2215/58; F25J 2240/10; F25J 2250/02; F25J 2280/50; F25J 3/04084; F25J 3/0409; F25J 3/04303; F25J 3/04387; F25J 3/04412; F25J 3/04672; F25J 3/04678; F25J 3/04709; F25J 3/048; F25J 3/0483; F25J 3/04848; F25J 3/04939; F25J 2245/58
See application file for complete search history.

(56) References Cited

U.S. PATENT DOCUMENTS

| | | | | |
|---|---|---|---|---|
| 10,408,534 | B2 * | 9/2019 | Kaminsky | B01D 7/02 |
| 10,578,357 | B2 * | 3/2020 | Saboda | B01J 19/30 |
| 10,684,071 | B2 * | 6/2020 | Larson | F25J 3/0409 |
| 10,690,408 | B2 * | 6/2020 | Lochner | F25J 3/04727 |
| 10,845,118 | B2 | 11/2020 | Golubev | |
| 11,378,332 | B2 * | 7/2022 | Valencia | B01D 1/16 |
| 11,713,921 | B2 * | 8/2023 | Parsnick | F25J 3/04963 62/643 |
| 2012/0125045 | A1 * | 5/2012 | Howard | F25J 3/04412 62/644 |
| 2016/0265841 | A1 * | 9/2016 | Lautenschlager | F25J 3/04666 |
| 2017/0051971 | A1 | 2/2017 | Goloubev | |
| 2017/0211880 | A1 * | 7/2017 | Alekseev | F25J 3/04109 |
| 2020/0318898 | A1 * | 10/2020 | Hirose | F25J 3/04284 |
| 2021/0140708 | A1 * | 5/2021 | Zhao | F25J 3/04412 |

OTHER PUBLICATIONS

J. Hahn, T. F. Edgar, "Process Control Systems", in Encyclopedia of Physical Science and Technology (Third Edition), 2003.

* cited by examiner

CRYOGENIC AIR RECTIFICATION SYSTEM, CONTROL UNIT, AIR SEPARATION UNIT AND METHOD OF CRYOGENICALLY SEPARATING AIR

The present invention relates to a cryogenic air rectification system, a control unit, an air separation unit and a method of cryogenically separating air.

BACKGROUND

The production of air products in liquid or gaseous state by cryogenic separation of feed air in air separation units (ASU) is well known and described, for example, in textbooks such as H.-W. Häring (ed.), Industrial Gases Processing, Wiley-VCH, 2006, especially section 2.2.5, "Cryogenic Rectification".

Air separation units may include rectification column systems provided as two-column systems, especially double-column systems such as classical Linde double-column systems, but also as single-column, three-column or multi-column systems. In addition to rectification columns for the recovery of nitrogen and/or oxygen in liquid and/or gaseous state, i.e. rectification columns for nitrogen-oxygen separation, such rectification column systems may comprise rectification columns for the recovery of other air components, in particular of noble gases.

The rectification columns of the rectification column systems just mentioned may be operated in different pressure ranges. Known double column systems may comprise a so-called pressure column (also called high pressure column, medium pressure column or lower column) and a so-called low pressure column (upper column). The high pressure column is typically operated in a pressure range of 4 to 7 bar, especially at about 5.3 bar, whereas the low pressure column is operated in a pressure range of typically 1 to 2 bar, especially at about 1.4 bar. In certain cases, higher pressures can also be used in both rectification columns. The pressures given here and below are absolute pressures at the top of the respective columns.

In U.S. Pat. No. 10,845,118 B2 (previously published as US 2017/051971 A1), a rectification column system and a unit for the production of oxygen by cryogenic fractionation of air is disclosed. The rectification column system comprises a high pressure column and a low pressure column, a main condenser, and an argon (removal) column with a top condenser. The low pressure column comprises an upper mass transfer zone, a lower mass transfer tone and an intermediate mass transfer zone. The top condenser of the argon (removal) column is arranged within the low pressure column between the lower and intermediate mass transfer zone and is configured as a forced-flow condenser evaporator.

EP 1 522 808 A1 discloses a cryogenic air separation system which is reported to optimize the recovery of argon. The system includes an air intake, a high-pressure distillation column, a low-pressure distillation column, a crude argon distillation column, and a controller that automatically controls the composition of the raw argon stream to decrease the concentration of oxygen while preventing the concentration of nitrogen from exceeding a selected value. The controller also controls the composition of the crude argon stream until an oxygen concentration reaches a selected value. The controller may include a multivariable predictive controller.

It is an object of the present invention to improve the construction and operation of air separation units of such a type, particularly in terms of capital and operating expenses, energy efficiency and ease and flexibility of control.

DISCLOSURE OF THE INVENTION

Against this background, a cryogenic air rectification system, a control unit, an air separation unit and a method of cryogenically separating feed air comprising the features of the independent claims is provided. Preferred embodiments of the invention are the subject of the dependent claims and of the description that follows.

The absolute and relative spatial and orientation terms above, below, adjacent, side-by-side, besides, vertical, horizontal, etc., are used herein to refer to the relative and absolute spatial positioning of components, regions, units, etc. in normal operation. If one component, region or unit is described herein as being arranged above another component, region or unit, this shall refer to the upper end of the lower of the two components, regions or units being at a lower or the same geodetic elevation as the lower end of the upper of the two components, regions or units, and the projections of the two components, regions or unit overlapping in a horizontal plane. In particular, the two components, regions or units may be positioned exactly above each other, i.e., the axes of the two components, regions or units perpendicular to the horizontal plane are on the same vertical straight line. However, the axes of the two components, regions or units do not have to be exactly perpendicular to each other, but can also be offset from each other, especially if one of the two components, regions or units, for example a rectification column or a column part with a smaller diameter, is to have the same distance to the wall of a coldbox as another with a larger diameter.

If a lower, an upper, and an intermediate component, region or unit is referred to herein, this is intended to express that the intermediate component, region or unit is arranged above the lower component, region or unit and the upper component, region or unit is arranged above the intermediate component, region or unit. Hereinbelow, the term "sideways" or "side-by-side" relates to a situation wherein the extensions of two components, regions or units between a lower end and an upper end at least in part overlap and the projections of the two components, regions or unit particularly do not overlap in a horizontal plane but overlap at least in part in a vertical plane.

Air separation units may include so-called condenser evaporators. For example, the main condenser of an air separation unit may be provided as a condenser evaporator. The term condenser evaporator refers to a heat exchanger in which a first condensing fluid stream enters into indirect heat exchange with a second evaporating fluid stream. Every condenser evaporator comprises a liquefaction space and an evaporation space consisting of liquefaction passages and evaporation passages, respectively. In the liquefaction space the condensation (liquefaction) of the first fluid stream is performed, and in the evaporation space the evaporation of the second fluid stream is performed. The evaporation space and liquefaction space are formed by groups of passages that are in a heat exchange relationship with one another. If, herein, reference is made to evaporation or liquefaction, this shall also include partial evaporation and liquefaction. Frequently, the terms condenser and evaporator are used instead of the technically correct term condenser evaporator.

As to different types of condenser evaporators and other apparatus used in air separation units, specific reference is made to expert literature such as Häring (see above), section 2.2.5.6, "Apparatus" Typically, the so-called main condenser of an air separation unit is configured as a bath evaporator, especially as a cascade evaporator as described in EP 1 287 302 B1. Bath and cascade evaporators are specific types of condenser evaporators. They may be formed by a single heat exchanger block or else by a plurality of heat exchanger blocks arranged in a common pressure vessel.

In a so-called forced-flow condenser evaporator, a liquid stream is forced (rather than aspirated as a result of the thermosiphon effect) through the evaporation space, particularly under its own pressure, and partially evaporated therein. This pressure is generated, for example, by means of a liquid column in the inlet conduit to the evaporation space. The height of this liquid column may then correspond to, or exceed, the pressure drop in the evaporation space. A biphasic fluid leaving the evaporation space, separated by phases, may be passed directly onward and, more particularly, is not introduced into a liquid bath of the condenser-evaporator from which the proportion remaining in liquid form is aspirated again. This is particularly the case for a so-called once through forced-flow condenser evaporator, wherein the terms "forced-flow" condenser evaporator and "once through" forced-flow condenser evaporator may also be used as synonyms herein.

Air separation units with crude and pure argon columns can be used for argon production. An example is illustrated by Häring (see above) in FIG. 2.3A and described from page 26 in the section "Rectification in the Low-pressure, Crude and Pure Argon Column" and from page 29 in the section "Cryogenic Production of Pure Argon". As explained there, argon accumulates or reaches a concentration maximum at a certain height in the low pressure column. At this or at another favorable point, possibly also below the argon maximum, the so-called argon transition, gas enriched in argon with an argon concentration of typically 5 to 15 mole percent can be withdrawn from the low pressure column and transferred to the crude argon column. This gas typically contains about 100 ppm nitrogen and otherwise essentially oxygen.

The terms oxygen section and argon section are commonly used in the field of cryogenic air separation and therefore readily understood by the skilled person. As e.g. explained in connection with FIG. 2.4 in Häring (see above), although the argon concentration of the ambient air is quite small with less than one percent, it has a strong impact on the concentration profile of the low pressure column. It would therefore not be adequate to describe the separation in the low pressure column as a binary oxygen-nitrogen rectification in which the presence of argon only represents a minor disturbance. This is because in the lowest section of the low pressure column, the so-called oxygen section, with about 30 to 40 theoretical trays, an essentially pure binary separation between oxygen and argon takes place. At the upper end of this section, where the argon content reaches its maximum and where the feed gas to the crude argon column, if present, is withdrawn, the binary oxygen-argon rectification transforms within a few theoretical trays into a ternary rectification.

Even if no production of argon is to be carried out in an air separation unit, it may prove advantageous to remove argon from the low pressure column. As mentioned, when a crude argon column is used, a corresponding argon removal is performed because gas enriched in argon is transferred from the low pressure column to the crude argon column, but essentially only the oxygen contained in this gas is returned to the low pressure column. By contrast, the argon discharged with a correspondingly extracted gas is permanently removed from the low pressure column.

The term argon removal is generally understood herein to mean a measure in which a gas containing argon is passed from or in the low pressure column to a dedicated separation unit and, after a depletion of argon, an oxygen-rich liquid is at least partially returned from this dedicated separation unit to the low pressure column. The classic way to remove argon is to use a crude argon column. However, argon removal columns explained below can also be used in this connection. The term "argon column" may therefore be used here as an umbrella term for argon discharge columns, full-scope crude argon columns and all intermediate stages in between.

The advantageous effect of argon removal is due to the fact that the separation of oxygen and argon is no longer required for the removed argon. The separation of oxygen and argon in the low pressure column itself is considered to be costly in terms of operating expenses and requires a corresponding heating capacity of the main condenser. By removing argon in a dedicated argon removal unit, the corresponding amount of argon no longer has to be separated in the oxygen section and the heating capacity of the main condenser can be reduced. Therefore, while maintaining the same yield of oxygen, for example, either more air can be injected into the low pressure column or more pressurized nitrogen can be removed from the high pressure column, each of which can offer energy advantages.

In a conventional crude argon column, as explained, crude argon is obtained and processed to pure argon in a downstream pure argon column. An argon removal column, on the other hand, is used primarily for removal of argon for the purpose of improving separation in the low pressure column. In principle, an argon removal column can be understood here as a rectification column for separating oxygen and argon, which is not used for obtaining a pure argon product but essentially for rejecting argon from the low pressure column.

In principle, the design of an argon removal column differs only slightly from that of a conventional crude argon column. However, an argon removal column typically contains significantly fewer theoretical trays, namely less than 40, in particular between 15 and 30. As with a conventional crude argon column, the sump section of an argon removal column in particular may be connected to an intermediate section of the low pressure column. An argon removal column can be cooled, in particular, by means of a top condenser in which the oxygen-enriched and nitrogen-depleted liquid withdrawn from the high pressure column is partially evaporated. An argon removal column typically does not comprise a sump evaporator.

If an argon product is required, such as may be the case in embodiments of the present invention, an argon removal column may also be used as a crude argon column where an oxygen-depleted or oxygen-free crude argon product is obtained at the top. The crude argon product may either be withdrawn from the system or sent to further workup in a pure argon column.

In U.S. Pat. No. 10,845,118 B2, which was already mentioned above, an argon (removal) column with a top condenser is arranged within the low pressure column. The top condenser of the argon (removal) column may be configured as a forced-flow (once-through) condenser evaporator and at the upper end thereof the evaporation space may be in fluid communication with the interior of the low pressure column, such that the gas produced therein can pass into the upper column region. The top condenser of the argon (removal) column is not necessarily arranged in the middle above the argon removal column (if the argon (removal) column is wholly or partly installed in the low pressure column). Instead, it is possible to utilize the entire cross section of the low pressure column. Embodiments of the present invention may comprise corresponding features as well. Hereinafter, when referring to embodiments of the present invention and configurations not forming part of the present invention, the term argon removal unit is used to cover argon removal columns integrated in the low pressure column (which are thus not provided as distinct columns), but also distinct argon removal columns. In all cases, an argon removal unit may also be used in ultimately forming an argon product as explained above for argon removal columns.

If an argon removal unit is integrated into the low pressure column, its mass transfer structures may be arranged sideways to further mass transfer structures of the low pressure column forming an argon section as generally known. An arrangement of such mass transfer structures besides one another can comprise a side-by-side arrangement wherein the structures are divided by a vertical wall or an arrangement wherein one structure is arranged concentrically within another. This may also be the case according to embodiments of the present invention.

While, in principle, the forced-flow condenser evaporator forming the top condenser of the argon removal unit can, in such an arrangement, like in standard argon production or argon removal methods, be operated with crude oxygen from the high pressure column (i.e. the liquid collected in the sump of the high pressure column), it is generally also possible to charge the evaporation space of the top condenser of the argon removal unit with a liquid which is collected from the upper column region of the low pressure column. For this purpose, a liquid collector may be connected below the upper column region to means of introducing liquid from the liquid collector via the inlet into the evaporation space of the top condenser of the argon removal unit. This particularly can also be the case according to embodiments of the present invention. Liquid running off from the upper mass transfer section may be combined in the liquid collector and introduced, for example, via a conduit into the evaporation space of the top condenser of the argon removal unit. The liquid thus serves to cool the top of the argon removal unit, particularly in a forced-flow once-through configuration of a condenser evaporator. Such a liquid is more oxygen-rich than the crude oxygen from the high pressure column and hence enables a smaller temperature differential and correspondingly smaller thermodynamic losses in the top condenser of the argon removal unit.

One of the main features of such an arrangement is a noticeably higher oxygen content in the liquid to be evaporated (approx. 70% instead of usual 38 to 40% oxygen for liquid oxygen stream from the high pressure column) due to fact that the liquid is collected at the bottom of the upper column region from essentially the whole upper column region. Another important feature is the large excess of liquid at the outlet on the evaporation side (the liquid fraction is higher than 50%), again due to use of the entire liquid flowing down the low pressure column (or its upper column region) as a cooling medium. This may also be the case according to embodiments of the present invention. The kettle liquid/crude oxygen stream from the high pressure column (i.e. the liquid collected in its sump) may be introduced into the low pressure column one separation section above the condenser evaporator of the argon removal unit. This may also be the case according to embodiments of the present invention In principle, it is possible according to embodiments of the present invention, rather than using a forced-flow condenser evaporator, to use a falling-film condenser evaporator, in which case all or almost all the liquid that flows downward in the upper mass transfer section likewise flows through the evaporation space of said falling-film condenser evaporator.

The cycle just explained, which basically may be used according to embodiments of the present invention, has a higher efficiency compared to an optimized conventional design. This is mainly because of a higher load of the column or due to a more suitable position of the condenser evaporator of the argon removal unit in the column. Particularly, the use of liquid with approx. 70% oxygen allows to have relatively small driving temperature difference in the condenser evaporator. Furthermore, there is no danger of running dry as a result of a high liquid excess at the condenser evaporator outlet in all operating cases.

According to the present invention, a cryogenic air rectification system comprising a high pressure column, a low pressure column and an argon removal unit coupled to a condenser evaporator is proposed, wherein the argon removal unit, particularly together with the condenser evaporator, may be provided as a rectification column separate from the low pressure column or integrated therein, as explained before. The wording "separate from the low pressure column" is used, in this connection, particularly used to indicate that the low pressure column and the argon removal unit are arranged side-by-side, or that the argon removal unit is arranged besides the low pressure column in the meaning indicated above. More generally, vertical projections to a horizontal plane of the low pressure column and the argon removal unit do not overlap for an argon removal unit separate from the low pressure column, as understood herein. In yet other words, a first, particularly partly cylindrical, vessel enclosing separation structures of the low pressure column and a second, likewise particularly partly cylindrical, vessel enclosing separation structures of the argon removal unit are provided. When the argon removal unit is integrated into the low pressure column, the vessel enclosing the separation structures of the low pressure column also encloses the separation structures of the argon removal unit. Herein, the term "sepraction structures" shall particularly refer to surface-enlarging structures such as trays and regular or irregular packings generally known in the field of separation technology and cryogenic air separation.

The proposed system is configured to pass gas from a position above an oxygen section of the low pressure column as an argon removal feed gas to a lower region of the argon removal unit, the system is configured to condense gas from an upper region of the argon removal unit in the condenser evaporator to form a condensate, the system is configured to pass further gas from the upper region of the argon removal unit out of the system, and the system is configured to pass at least a part of the condensate as a reflux to the upper region of the argon removal unit. The system comprises a control unit configured to control an oxygen content of the argon removal feed gas as a controlled variable using a flow of the further gas from the upper region of the argon removal unit being passed out of the system as a manipulated variable on the basis of an oxygen content determined in the argon removal feed gas using a feedback control structure.

Aspects of the present disclosure therefore relate to process control units and methods, particularly using principles of feedback control as generally known to the skilled person.

As to the terms used herein, reference is made to expert literature and textbooks, e.g. J. Hahn, T. F. Edgar, "Process Control Systems", in Encyclopedia of Physical Science and Technology (Third Edition), 2003.

The purpose of feedback control is to keep a value of a controlled variable at or close to a set point, said setpoint also being referred to as a reference variable. That is, the term "controlled variable", as used herein, is understood as being a process variable which is maintained at a specific value or within a specified range in a (feedback) control method or unit. This may generally be achieved by using the difference between the set point and the controlled variable to determine the value of the input to the feedback controller or control unit. The feedback controller by its design takes corrective action to reduce the deviation. This action may be a negative feedback, because the manipulated variable may move in a direction opposite in sign to the error. Control methods or units may generally act upon one or more manipulated variables in this connection. Therefore, the term "manipulated variable" is used herein as referring to a process variable that is acted on by the control method or unit to maintain the controlled variable at the specified value or within the specified range. Feedback controllers may make use of user-specified parameters that can be adjusted to achieve desirable dynamic performance. Generally, control methods or units may use certain inputs, i.e. stimuli applied to the control method or unit from an external source to produce a specific response. They may produce certain outputs, i.e. actual responses. In feedback control methods, the feedback is information in a closed-loop control method or unit about the condition of process variable.

The further gas from the upper region of the argon removal unit referred to as being passed out of the system may be a waste gas stream, i.e. may be passed through in the main heat exchanger and then may be vented to the atmosphere. However, the further gas from the upper region of the argon removal unit being passed out of the system may likewise be used for forming an argon product. It may generally be treated in any manner conceivable, and a reference to a "waste gas stream" hereinbelow is not intended to exclude the other possibilities. Generally, however, the further gas from the upper region of the argon removal unit being passed out of the system is not, wholly or in parts, intentionally reintroduced into the nitrogen/oxygen rectification column system. This does obviously not exclude that argon molecules vented to the atmosphere can be aspirated again by the main air compressor of the air separation unit.

As proposed herein, the condenser evaporator is configured to at least partly evaporate a coolant, forming an evaporated gas. As the coolant, oxygen-enriched and nitrogen-depleted liquid withdrawn from the high pressure column may be used. In other configurations, a liquid which is collected from the upper column region of the low pressure column may be used as the coolant. Any other suitable coolant, or mixtures of different coolants, may likewise be used in embodiments of the present invention, particularly cryogenic liquids withdrawn from either of the rectification columns.

As further proposed herein, the evaporated gas, or a part thereof, is uncontrolledly, i.e. particularly without restriction of a valve or other flow restriction device (but somewhat restricted by the diameter of a connection used, for example), passed into the low pressure column, particularly at a point or feed position at which a composition of a fluid in the low pressure column corresponds, at least in its oxygen and nitrogen content, to that of the evaporated gas, or at which a feed of the evaporated gas is particularly advantageous. The evaporated gas, or the part thereof uncontrolledly passed into the low pressure column may particularly be passed through a passage or tubing being connected at the feed position with the low pressure column, or it may be passed into the low pressure column by letting it raise in an intermediate section thereof to an upper section.

A system configured as just explained may, in contrast to a system wherein such evaporated gas is passed into the low pressure column via a controlled valve, be provided in simpler design and with lower cost. Unexpectedly, as identified by the present invention, a reliable operation of a corresponding system may, particularly using the control mechanisms proposed in embodiments of the present invention, be realized even if the restricting valve is omitted.

According to embodiments of the present invention, a condenser feed gas stream may be formed from gas from the upper region of the argon removal unit and this condenser feed gas stream may be partially condensed to form a biphasic stream including a liquid phase and a gas phase. The condensate passed as a reflux to the upper region of the argon removal unit may in particular be at least a part of the liquid phase of the biphasic stream while the further gas from the upper region of the argon removal unit being passed out of the system may be at least a part of the gas phase. This gas phase may be separated from the condensate by using a syphon, for example. In alternative embodiments, however, the further gas from the upper region of the argon removal unit being passed out of the system may also be further gas from the upper region of the argon removal unit which is not used in forming the biphasic stream. That is, gas intended to be passed out of the system may be withdrawn upstream or downstream of the condenser in these alternative embodiments.

While the underlying arrangement, according to embodiments of the present invention may generally correspond to what was described before, aspects of the present invention particularly relate to a control concept. A feature of the proposed control concept is to control the duty of the condenser evaporator of the argon removal unit and thus the vapor load of the argon removal unit. Instead of the heat transfer area, the driving temperature difference is influenced. By adjusting the amount of the gas from the upper region of the argon removal unit being passed out of the system, the concentration dependency of the dew temperature of the argon-rich mixture in the condenser evaporator of the argon removal unit as well as the bubble point temperature of the oxygen-rich fluid on the evaporation side is utilized to control the duty of the condenser evaporator in which particularly liquid collected from the upper column region as indicated above may be evaporated.

Advantages provided according to embodiments of the present invention include that no overdesign of the core of the condenser evaporator of the argon removal unit is required (as for alternative control concepts with heat transfer blanketing). Furthermore, no large liquid valve on the condenser side is required. Waste argon or argon to be used for forming an argon product (the "gas from the upper region of the argon removal unit being passed out of the system") may be withdrawn upstream or downstream of the condenser. The present invention may be used with conventional argon removal columns.

Particularly, a feedback control structure used according to embodiments of the present may be a cascade control structure including an analysis (indicating) controller as a primary controller and a flow (indicating) controller or a hand controller as a secondary controller.

The use of the oxygen content in the argon removal feed, i.e. the feed to the argon removal unit, as controlled variable has several advantages. First, there is a unique correspondence of oxygen content in the argon removal feed and condenser duty, which allows for a reliable control of the vapor load of the argon removal unit. Second, as the measurement of the oxygen content in the argon removal feed is mandatory for air separation units with argon systems, no additional measurement equipment is required. Apart from that, this type of control can be applied to conventional argon removal columns as well, as illustrated below.

According to an embodiment of the present invention, the primary controller of a cascade control structure may therefore be configured to control the oxygen content of the argon removal feed gas and the secondary controller may be configured to adjust the flow of the part of the gas from the upper region of the argon removal unit being passed out of the system using a flow set point for the secondary controller as the manipulated value. According to such an embodiment, the control unit may be adapted to perform a trim control including a ramping of the flow set point (in particular when a flow controller is used) or including a ramping of a valve stroke (if a hand controller is used). This configuration, in other words, allows for a trim control (manual ramping of flow set point and adjustment of flow set point by analysis indicating controller in a defined interval) and additionally, in embodiments, a state-of-the-art automatic load change (ALC) can be used as well. Additionally, it can be used as regular control loop in an automatic load change.

According to an embodiment of the present invention, the low pressure column may comprise a lower column region, an intermediate column region arranged above the lower column region, and an upper column region arranged above the intermediate column region, the lower column region including the oxygen section and the intermediate column region including a rectification section of the argon removal unit. The lower, intermediate and upper column regions may, despite from the features integrated therein and their separation by features within the columns, contiguous regions in an outer column shell. In such a configuration, the lower region of the argon removal unit may a bottom or underside open with respect to an upper region of the oxygen section to allow an entry of a part of a gas flow raising in the oxygen section as the argon removal feed gas. The rectification section of the argon removal unit may at least in part be arranged in a common space with an argon section of the low pressure column which comprises a bottom or underside open with respect to the upper region of the oxygen section to allow an entry of a further part of the gas flow raising in the oxygen section.

According to an embodiment of the present invention, the condenser evaporator is arranged above the rectification section of the argon removal unit in the intermediate column region. This allows for an improved heat integration and particularly allows for a constructionally improved feed with liquid collected in the upper column region of the low pressure column as indicated above.

In alternative embodiments of the present invention, the condenser evaporator is arranged above the argon removal column to form a rectification unit arranged besides the low pressure column. As to the terms "above" and "besides", reference is made to the explanations above. Such alternative embodiments of present invention therefore particularly do not relate to the embodiments of the present invention wherein the argon removal column is configured as just explained.

Particularly, the condenser evaporator may, in embodiments of the invention be a forced-flow condenser evaporator. It may be configured to at least partly evaporate, as the coolant mentioned above, a liquid collected from the intermediate column region, particularly to form the evaporated gas mentioned and a liquid stream which likewise may be passed to the argon section of the low pressure column. For further explanations, reference is made to the explanations above. In other embodiments, the condenser evaporator may be configured to at least partly evaporate, as the coolant, a liquid collected in a lower region of the high pressure column, particularly a sump liquid thereof with the composition already indicated above.

In embodiments of the present invention, which already mentioned before, the argon removal unit and the condenser evaporator are provided separate from the low pressure column. This allows for the argon removal column according to such embodiments of the invention being retrofitted in existing plants in a corresponding configuration.

A control unit configured to control an air rectification system is also part of the present invention, the air rectification system comprising a high a pressure column, a low pressure column and an argon removal unit coupled to a condenser evaporator, wherein the argon removal unit is provided as a rectification column separate from the low pressure column or integrated therein, wherein the system is configured to pass gas from a position above an oxygen section of the low pressure column as an argon removal feed gas to a lower region of the argon removal unit, wherein the system is configured to condense gas from an upper region of the argon removal unit in the condenser evaporator to form a condensate, wherein the system is configured to pass further gas from the upper region of the argon removal unit out of the system, and wherein the system is configured to pass at least a part of the condensate as a reflux to the upper region of the argon removal unit. The proposed control unit is configured to control an oxygen content of the argon removal feed gas as a controlled variable using a flow of the further gas from the upper region of the argon removal unit being passed out of the system as a manipulated variable on the basis of a oxygen content determined in the argon removal feed gas using a feedback control structure. Furthermore, in the controlled system, the condenser evaporator is configured to at least partly evaporate a coolant forming an evaporated gas, and the controlled system is configured to pass the evaporated gas, or a part thereof, uncontrolledly into the low pressure column, particularly as indicated above.

For further embodiments of a corresponding control unit, reference is made to the explanations above. Likewise, an air separation unit which is adapted to cryogenically separate feed air, and which comprises, according to the present invention, a system as explained above may including corresponding embodiments.

A further aspect of the present invention is a method for cryogenically separating feed air using an air rectification system comprising high a pressure column, a low pressure column and an argon removal unit coupled to a condenser evaporator, wherein gas from a position above an oxygen section of the low pressure column is passed to a lower region of the argon removal unit as an argon removal feed gas, wherein gas from an upper region of the argon removal unit is condensed in the condenser evaporator to form a condensate, wherein further gas from the upper region of the argon removal unit is passed out of the system, and wherein at least a part of the condensate is passed as a reflux to the upper region of the argon removal unit.

A control unit is used in controlling an oxygen content of the argon removal feed gas as a controlled variable using a flow of the further gas from the upper region of the argon removal unit being passed out of the system as a manipulated variable on the basis of an oxygen content determined in the argon removal feed gas using a feedback control structure is used.

In the proposed method, a coolant is at least partly evaporated in the condenser evaporator, forming an evaporated gas, and the evaporated gas, or a part thereof, is passed uncontrolledly into the low pressure column.

In the method, for whose embodiments and advantages likewise reference is made to the explanations above, an air rectification system according to any one of the embodiments explained above and combinations thereof may be used.

SHORT DESCRIPTION OF THE FIGURES

In the Figures, components with comparable or identical function are indicated with like reference numerals. A repeated explanation is omitted for reasons of conciseness only.

EMBODIMENTS OF THE INVENTION

Figure 1:
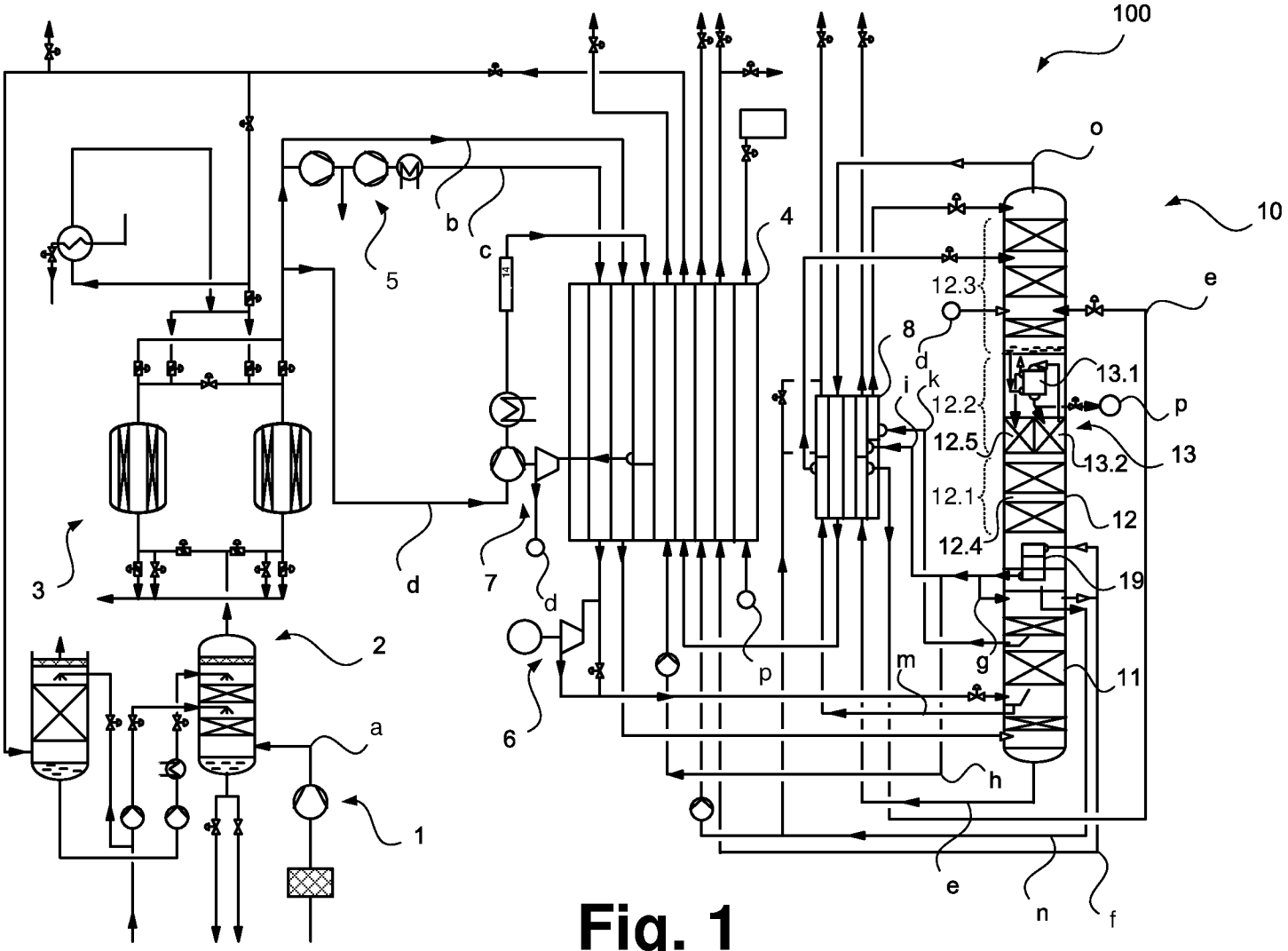
FIG. 1 illustrates an air separation unit.

FIG. 1 shows an air separation unit which may form the basis of an embodiment of the present invention in the form of a simplified, schematic process flow diagram. The air separation unit is indicated with 100.

In a compression unit 1 of the air separation unit 100, which may include a main air compressor as generally known in the field of air separation and which may comprise different compressor units or compressor stages with aftercoolers, respectively, an amount of feed air aspirated via a filter from the atmosphere is compressed to form a feed air stream a. The feed air stream a is cooled in a direct contact cooling unit 2 with water as also generally known in the field of cryogenic air separation and, still indicated a, supplied to a purification unit 3 which, in the embodiment illustrated, comprises two adsorber lines each containing two adsorption vessels. The feed air stream a is purified in parallel streams in the purification unit 3 as also known per se.

The purified feed air stream, still indicated a, is subdivided into partial streams b, c and d. Partial stream b is, without further compression, passed from the warm end to the cold end through the main heat exchanger 4 and then into the high pressure column 11 of a rectification column system 10 comprising the high pressure column 11, a low pressure column 12 and an argon removal unit 13 with a condenser evaporator 13.1 arranged in the low pressure column 12. More specifically, the low pressure column 12 comprises a lower column region 12.1, an intermediate column region 12.2 arranged above the lower column region 12.1, and an upper column region 12.3 arranged above the intermediate column region 12.2, the lower column region 12.1 including an oxygen section 12.4 of the low pressure column and the intermediate column region 12.2 including a rectification section 13.2 of the argon removal unit 13. Besides the rectification section 13.2 of the argon removal unit 13, there is arranged an argon section 12.5 of the low pressure column in the intermediate column region 12.2.

Partial stream c is further compressed in a booster air compressor 5 of the air separation unit 100 and thereafter, as a Joule Thomson stream, likewise passed from the warm end to the cold end through the main heat exchanger 4 and then expanded, e.g. using an expansion arrangement 6 comprising a valve and a dense liquid expander, into the high pressure column 11. Partial stream d is, in the example shown, self boostered in a turbine booster arrangement 7 and then expanded into the low pressure column as illustrated by connection d.

Enriched liquid from the sump of the high pressure column is, as illustrated with e, passed through a subcooler 8 and thereafter expanded into the low pressure column 12. In a manner known per se, nitrogen-rich gas is withdrawn from the top of the high pressure column 11. A first part thereof, illustrated with f, is heated in gaseous stated in the main heat exchanger 4 and withdrawn from the air separation unit 100 as a gaseous nitrogen product. The rest of the nitrogen-rich gas withdrawn from the top of the high pressure column 11 is, in the example illustrated, mostly condensed in a main condenser 19 interconnecting the high and low pressure columns 11, 12. A part of the condensate thus formed, which is indicated g, is refluxed to the high pressure column 11 while a further part, indicated h, is internally compressed and a yet further part, indicated i, is subcooled in subcooler 8 and provided as a liquid nitrogen product. An intermediate stream k is passed through subcooler 8 and expanded into the low pressure column, as is a liquid m withdrawn at the feed point of stream c.

An oxygen product is produced by internally compressing sump liquid n withdrawn from the low pressure column 12. Waste nitrogen o is withdrawn from the top of the low pressure column 12 while waste argon p is withdrawn from the condenser evaporator 13.1 of the argon removal unit as further illustrated below.

Figure 2:
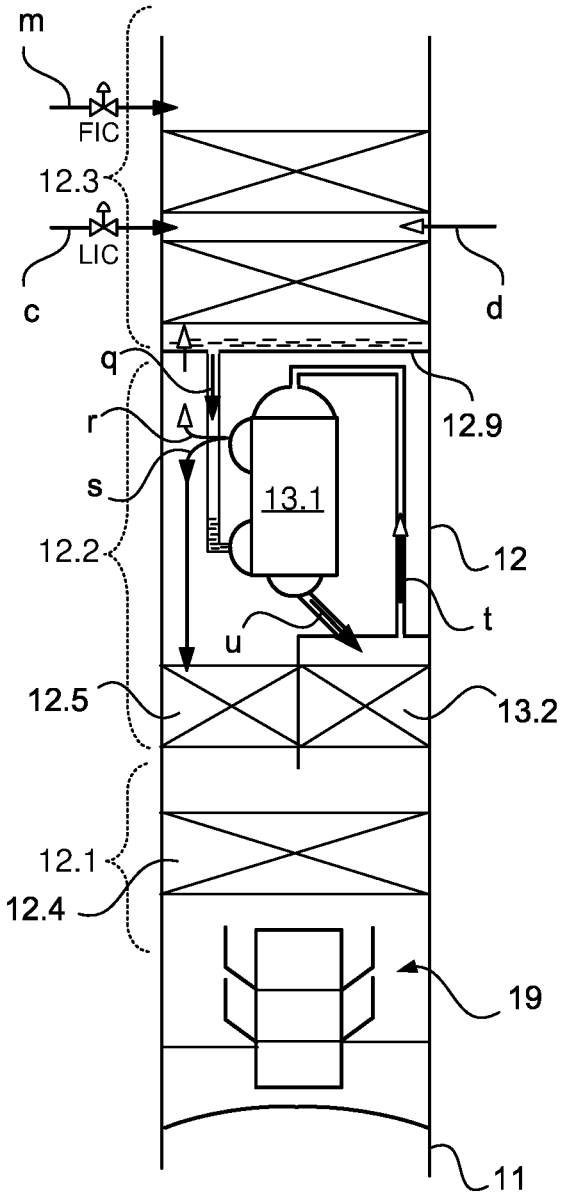
FIGS. 2 and 3 are detail views of an air separation unit.

FIG. 2 is a detail view of an air separation unit such as the air separation unit 100 according to FIG. 1 including the lower part of the upper column region 12.3, the intermediate column region 12.2 and the lower column region 12.1 and an upper end of the high pressure column 11. All elements and streams are indicated with like reference numerals as before and reference is made to the explanations above. As shown, the lower region of the argon removal unit 13, i.e. its rectification section 13.2, comprises a bottom or underside open with respect to an upper region of the oxygen section 12.4 to allow an entry of a part of a gas flow raising in the oxygen section 12.4 as an argon removal feed gas and the rectification section 13.2 of the argon removal unit 13 is arranged in a common space with an argon section 12.5 of the low pressure column 12 which comprises a bottom or underside open with respect to the upper region of the oxygen section 12.4 to allow an entry of a further part of the gas flow raising in the oxygen section 12.4.

The condenser evaporator 13.1 is in this example arranged above the rectification section 13.2 of the argon removal unit 13 in the intermediate column region 12.2 and the condenser evaporator 13.1 is provided as a forced-flow condenser evaporator 13.1 configured to at partly evaporate a liquid containing about 70% oxygen collected from the intermediate column region 12.2 at a collector tray 12.9 and forcedly passed to the condenser evaporator 13.1 in the form of a liquid stream q. By said partial evaporation, a gas stream r to be passed to the upper column region 12.3 and a liquid stream s to be passed to the argon section 12.5 are provided. That is, the condenser evaporator 13.1 is configured to at least partly evaporate a coolant in form of the liquid stream q forming an evaporated gas r, and the evaporated gas r is uncontrolledly passed into the low pressure column 12 by simply releasing the same.

Gas raising from the rectification section 13.2 of the argon removal unit 13 is collected in the form of a stream t and partly condensed in the condenser evaporator 13.1 to form a biphasic stream. Using e.g. a syphon, a gas phase and a liquid phase contained in the biphasic stream are at least in part separated from each other and, in the general example shown, the liquid phase is refluxed to the rectification section 13.2 of the argon removal unit in the form of a stream u. That is, a part of the gas raising from the rectification section 13.2 of the argon removal unit 13 is, in form of the condensate, refluxed to the rectification section 13.2 of the argon removal unit As illustrated as before with p, but not explicitly illustrated in FIG. 2, a further part of the gas raising from the rectification section 13.2 of the argon removal unit 13 may, in the form of the gas phase of the biphasic stream downstream of the condenser evaporator 13.1, i.e. in the form of the part not condensed in the condenser evaporator 13.1 and thus not refluxed to the rectification section 13.2 of the argon removal unit 13, passed out of the system 10 and the air separation unit 100. Reference is made to FIG. 1, for example. As mentioned, a corresponding gas stream can, however, can also be formed from gas withdrawn upstream of the condenser evaporator 13.1.

Figure 3:
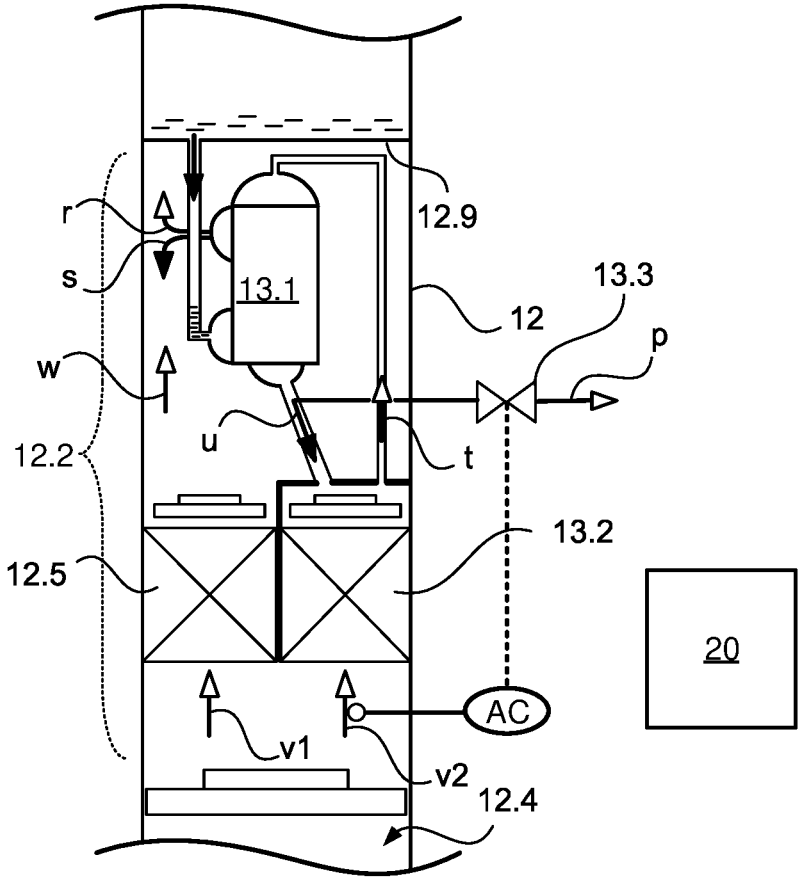

FIG. 3 is a detail view of an air separation unit such as the air separation unit 100 according to FIG. 1 wherein also the components shown in FIG. 2 are partially illustrated. Therefore, as to these components, reference is made to the explanations above. As a focus is placed here to the intermediate column region 12.2 and the components therein, the upper and lower column regions 12.3 and 12.1 are shown in reduced detail only. Gas raising from oxygen section 12.4, or, more precisely, parts thereof passed to the argon section 12.4 and the rectification section 13.2 of the argon removal unit 13 are indicated with v1 and v2. Gas raising in the region of the condenser evaporator 13.1 is indicated w. As mentioned before and illustrated in FIG. 3, a stream p may be formed from the gas raising from the rectification section 13.2 of the argon removal unit 13 by using the, or a part of the gas phase of the biphasic stream downstream of the condenser evaporator 13.1, i.e. in the form of the part not condensed in the condenser evaporator 13.1 and thus not refluxed to the rectification section 13.2 of the argon removal unit 13. Reference is made to the explanations above.

A flow of the stream p is adjusted by using a valve 13.3. A control unit 20 is provided which is configured to control an oxygen content of the feed gas to the argon removal unit 13.1, i.e. stream v2 (and v1) as a controlled variable using a flow of stream p, i.e. the further gas from the top of the argon removal unit 13.1 being withdrawn as a manipulated variable, on the basis of an oxygen content determined in the feed gas to the argon removal unit 13.1 using a feedback control structure including an analysis (indicating) controller AC as illustrated.

Figure 4:
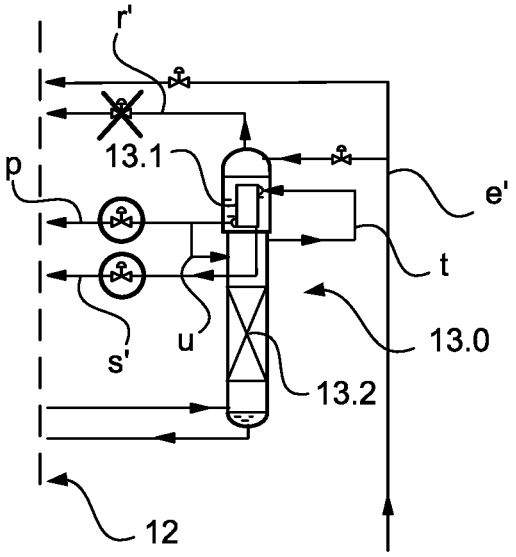
FIG. 4 is a detail view of an argon removal column.

FIG. 4 is a detail view of an argon removal unit provided, according to an embodiment of the present invention, as an argon removal column 13.0 external to the low pressure column 12 whose condenser evaporator 13.1 is cooled by liquid from the sump of the high pressure column 11 in the form of a stream e' provided in essentially the same manner as the stream e according to FIG. 1. Other coolants may likewise be used. A part of the stream e' not used for cooling is passed directly to the low pressure column in the form of a stream e".

As before, a stream of gas raising in the rectification section 13.2 of the argon removal unit 13 is indicated t, a part of the condensate refluxed to the rectification section 13.2 of the argon removal unit 13 is indicated u, and a waste argon stream is indicated p. Gaseous and liquid streams withdrawn from an evaporation space of condenser evaporator 13.1 are passed as streams r' and s' to the low pressure column 12. As indicated by a crossed-out valve in the stream r', such a valve can be omitted by using the control strategy according to an embodiment of the present invention. A valve in stream p (and s') is generally always available and preferably provided as a warm valve outside a coldbox. As illustrated in FIG. 4, therefore, the condenser evaporator 13.1 is configured to at least partly evaporate a coolant forming an evaporated gas, and the overall system 10 is configured to pass the evaporated gas uncontrolledly into the low pressure column 12, i.e. without the restriction of a flow restricting device.

FIGS. 5 to 12 are diagrams illustrating certain aspects. In all diagrams, a time in seconds is indicated on the horizontal axis and the other values discussed below are indicated on the vertical axis.

Two case studies have been conducted using a digital twin based on the concept of Kender et al., Development of a Digital Twin for a Flexible Air Separation Unit Using a Pressure-Driven Simulation Approach, Computers & Chemical Engineering, 151, 107349, 2021 using simulation models described in DE 10 2020 000 464 A1. These studies include dynamic simulations for a plant disturbance scenario as well as a state-of-the-art load change procedure to evaluate the proposed control concept. In addition, the plant disturbance scenario may be simulated with a legacy concept (blanketing of heat transfer area) to compare the results to the proposed concept.

Figure 5:
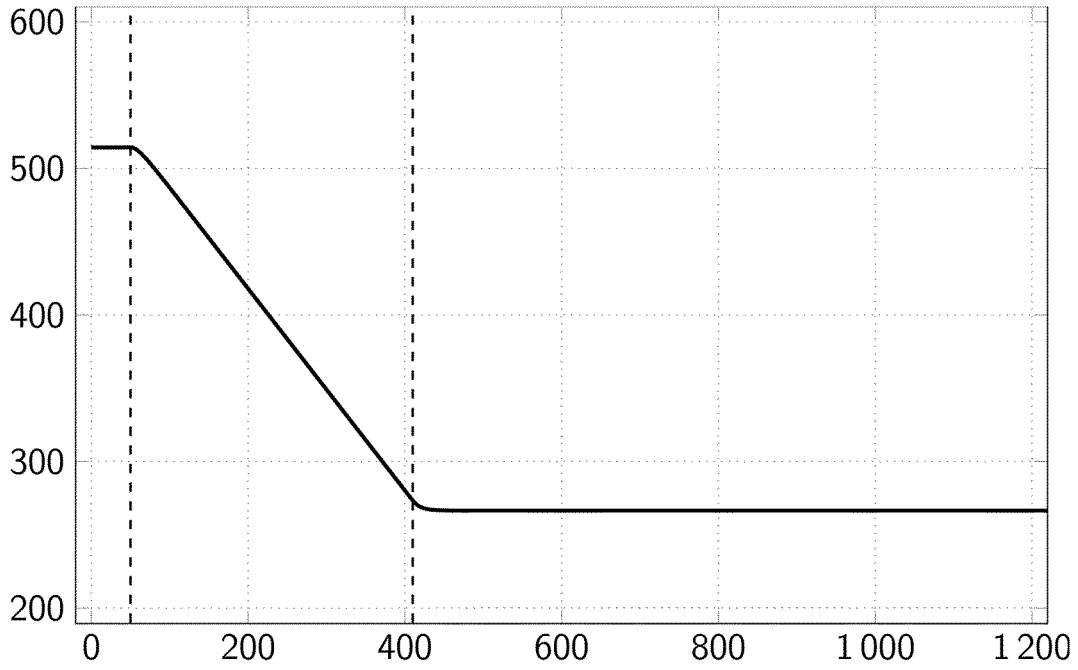
FIGS. 5 to 12 are diagrams illustrating aspects of embodiments of the invention.
Figure 6:
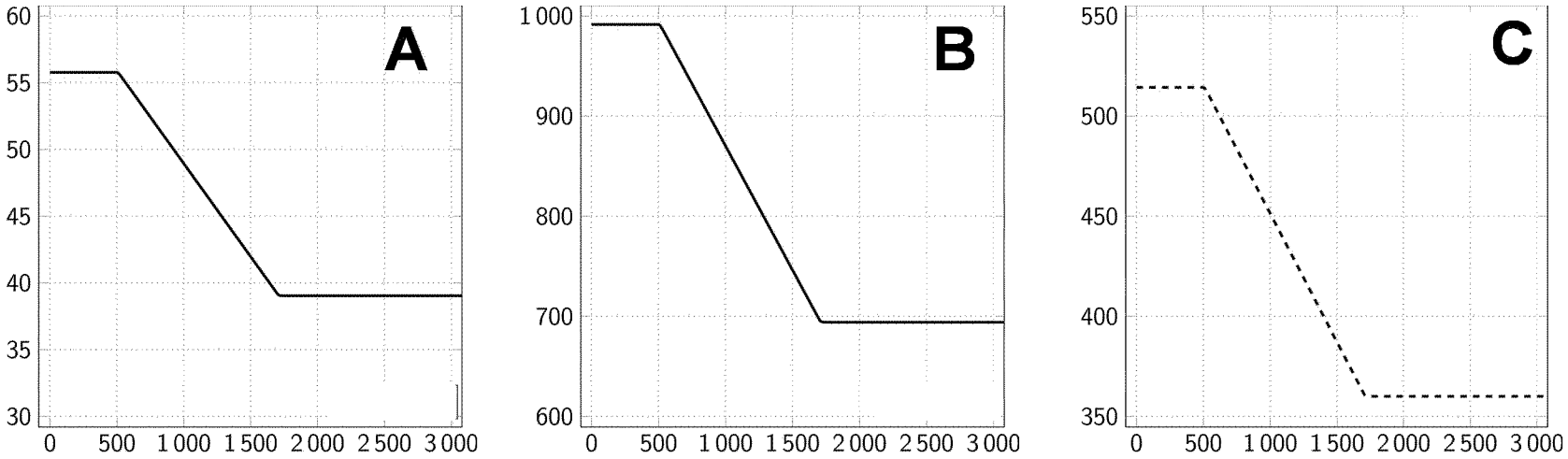

As a plant disturbance scenario, the amount of pressurized gaseous nitrogen product such as stream f according to FIG. 1 (also referred to as PGAN) is changed with a rate of 8 percent per minute to impact the main condenser duty, as visualized in the diagram of FIG. 5. Simulations were based on 20000 normalized cubic metres per hour of the gaseous nitrogen (i.e. PGAN, 41500 to 21500 normalized cubic metres per hour at 5 bar absolute pressure from the high pressure column). In the diagram shown in FIG. 5, a flow is shown in moles per second on the vertical axis. Dashed lines in the diagram represent the start and end times of the set point change.

As load change, a 100 to 70 percent state-of-the-art turn-down scenario using automatic load change was considered to evaluate the control concept. In detail, the products were changed as follows with a load change rate of 1 percent per minute: 4500 to 3150 standard cubic meters per hour internally compressed nitrogen, such as stream h according to FIG. 1, 80000 to 56000 standard cubic meters per hour internally compressed oxygen, such as stream n according to FIG. 1, and 41500 to 29050 standard cubic meters per hour gaseous nitrogen withdrawn at 5 bar absolute pressure from the high pressure column, such as stream f according to FIG. 1 (i.e. PGAN). Flows are shown in moles per second on the vertical axis in diagrams A (internally compressed nitrogen), B (internally compressed oxygen) and C (pressurized nitrogen withdrawn from high pressure column, PGAN) of FIG. 6.

This study was used as an example to evaluate the behaviors of the proposed control concept to a disturbance in plant operation. The fast reduction of the nitrogen product withdrawn from the high pressure column (PGAN, 8 percent per minute) leads to a swift increase of the main condenser duty and thus to an increase of the gas load in the low pressure column.

Figure 7:
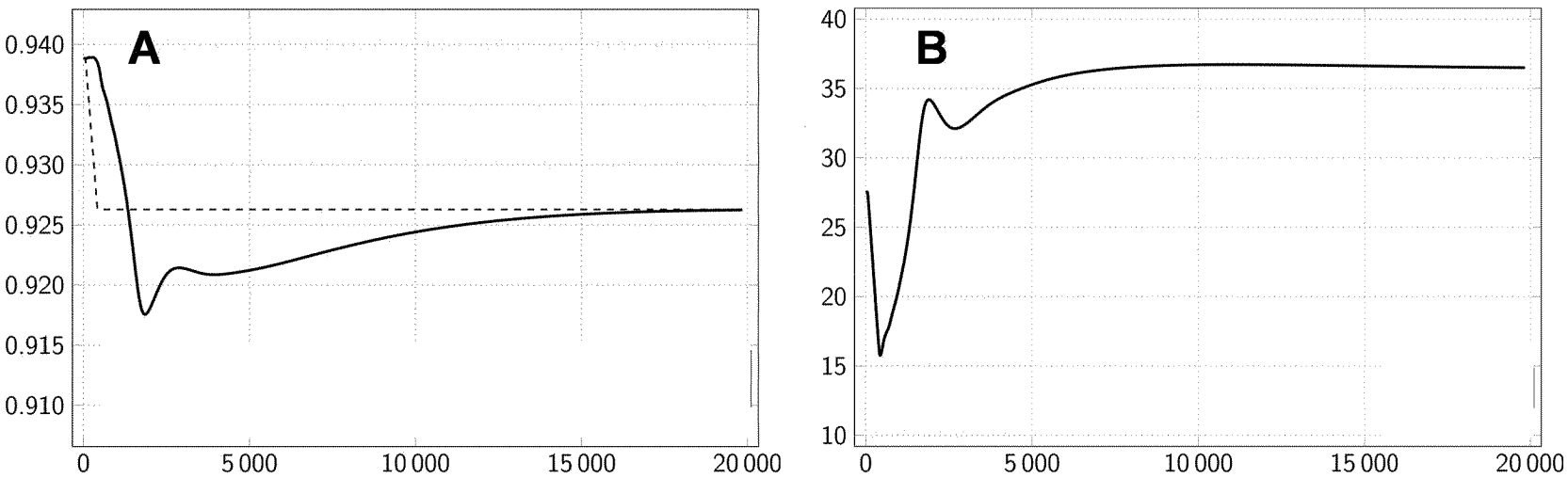

FIG. 7 shows the required set point changes for the analysis control loop controlling the oxygen content in the gas to the argon removal unit for the partial load case just described in diagram A (dimensionless) and argon passed out of the system in diagram B (in moles per second). The value for the oxygen content is pre-calculated in an additional steady-state simulation. The set point change is linear in nature. The black, dashed line in diagram A represents the set point change whereas the solid line is the actual graph of the oxygen content. The rapid decrease in the oxygen content can be counteracted using the amount of argon passed out of the system until the oxygen content converges to its desired set point. Thus, by adjusting the flow of argon passed out of the system accordingly, the proposed control loop is able to react to a plant disturbance in a reliable manner.

Figure 8:
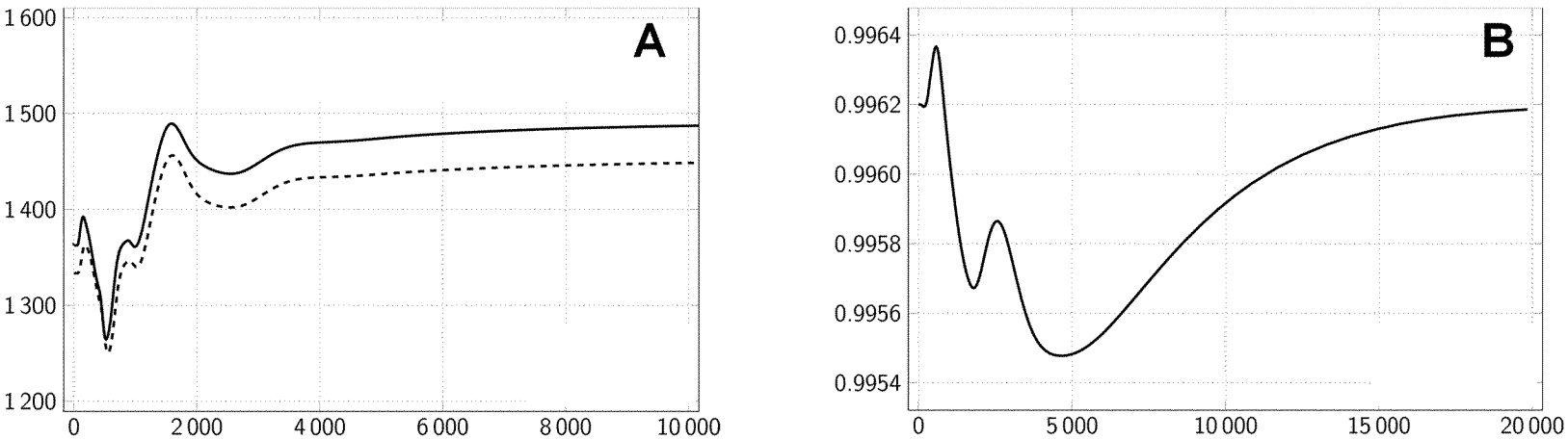

In FIG. 8, relevant aspects of the plant response are illustrated. In diagram A, the outgoing vapor (top) and liquid (bottom) flows of the uppermost theoretical tray of the argon removal unit are shown in moles per second on the vertical axis. Diagram B shows the oxygen molar fraction of the internally compressed oxygen product resulting on the vertical axis.

The vapor and liquid flows of the uppermost theoretical tray are representative for the load of the argon removal unit. Approximately 1 hour after the disturbance, stable flow conditions can be observed in this. This shows that the proposed control concept is able to establish a new stable column state in little time. In addition, the applied control ensured the changes in the flows due to the plant disturbance remained within a small interval. The oxygen content of the internally compressed oxygen product is shown in diagram B of FIG. 8, as mentioned. The graph of the product purity is similar to the oxygen content in the feed stream to the argon removal unit (see FIG. 7). Compared to the latter stream, the changes in oxygen content in the internally compressed oxygen product are visible with a temporal delay, dampened by the holdup of the oxygen section. Thus, the proposed control concept is beneficial for the adherence of the product purity constraints for the internally compressed oxygen product.

Figure 9:
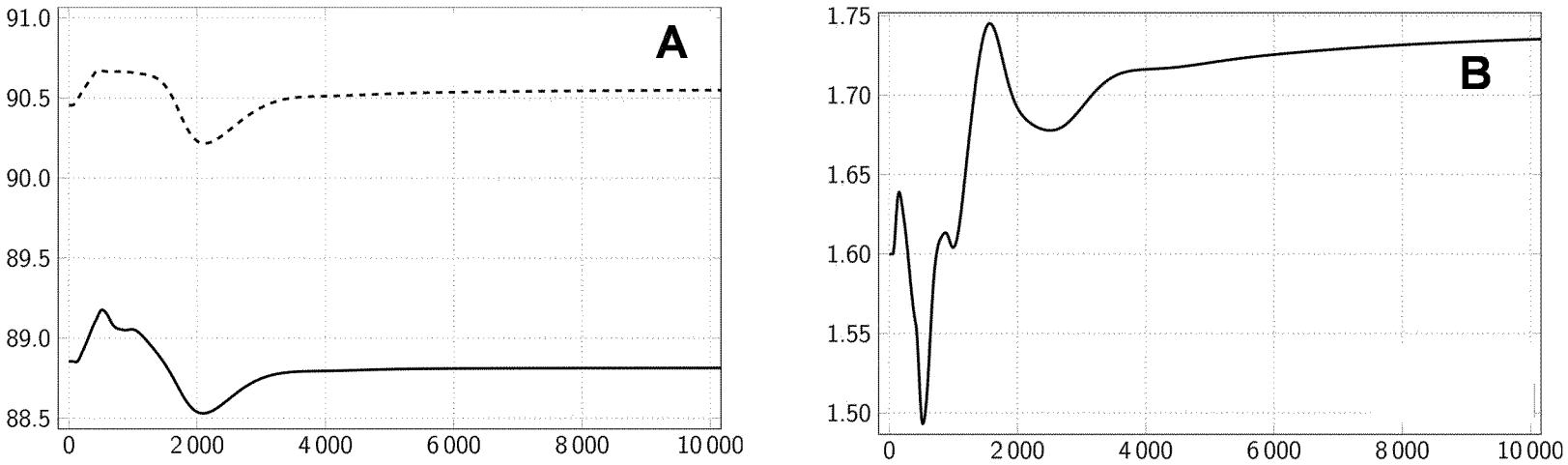

To visualize the functionality of the proposed control concept, the temperature on both sides of the forced flow condenser (diagram A) and the resulting temperature difference MTD at the forced flow condenser (diagram B) are displayed in FIG. 9. In Diagram A, as relevant plant response the dew point temperature of the condensate formed from the gas from the argon removal unit (condenser side) and the bubble point temperature of oxygen (at the evaporation side) of the forced flow condenser are illustrated while diagram B illustrates the MTD of these two streams.

The graph B of the MTD is identical to the behaviors of the integrated argon removal column load over time (see FIG. 8, diagram A). This proves that the proposed concept works as stated above. The argon column load is explicitly controlled via the manipulation of the forced flow condenser duty via the driving temperature difference MTD. In addition, diagram A of FIG. 9 shows that the adjustment of the waste argon stream (see FIG. 7, diagram B) and the resulting change of oxygen content in the feed stream to the argon removal unit (see FIG. 7, diagram A) influences both temperatures of the forced flow condenser. This study shows that the proposed control concept allows for a swift reaction on a plant disturbance (reduction of the pressurized nitrogen flow (PGAN) by half with 8 percent per minute as described above). A new stable plant state is established approximately 1 hour after the disturbance ends. Furthermore, the oxygen content of the feed stream to the argon removal unit is an early indication of the behaviors of the internally compressed oxygen product. Thus, controlling this oxygen content is additionally beneficial for plant operations.

Figure 10:
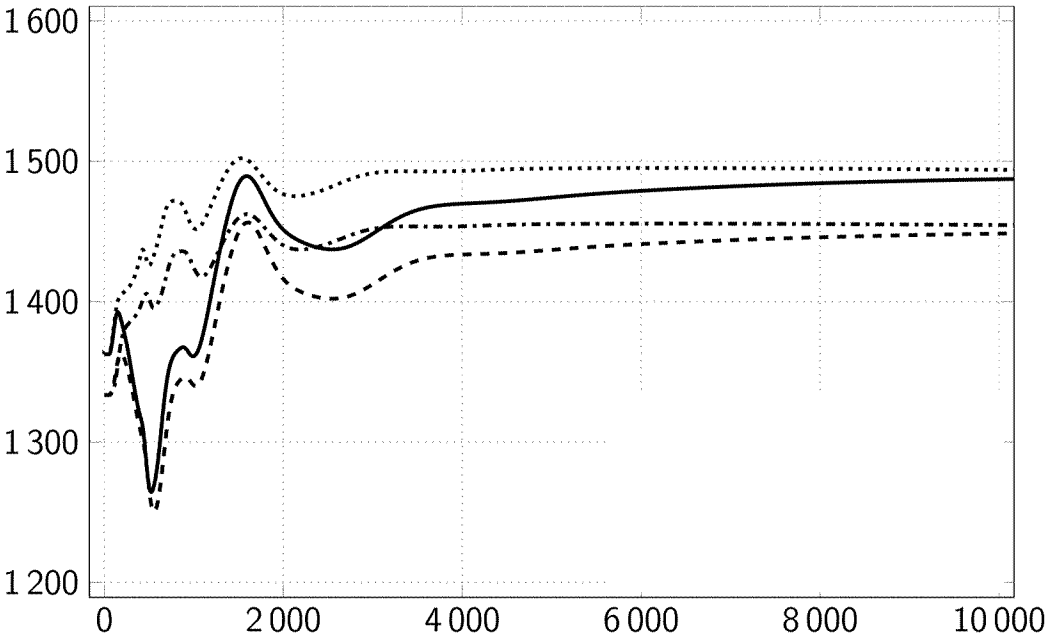

To compare the proposed analysis indicating controller concept to a legacy concept, the outgoing vapor and liquid flows of the uppermost theoretical tray of the argon removal column for both concepts are shown in FIG. 10. The results obtained for the proposed concepts are indicated with solid lines while the results obtained for the legacy concept are indicated with dashed lines. The upper dashed and dotted line indicates a vapor and the lower dashed and dotted line indicates a liquid flow, each in moles per second.

The vapor and liquid flows of the uppermost theoretical tray are representative for the load of the argon removal unit. Both concepts show a similar behaviors of the column load during the plant disturbance and converge with the same end value. That is, the proposed concept can reproduce the behaviors of the field proven concept. However, the proposed concept has certain advantages which are discussed above.

Furthermore, a state-of-the-art load change procedure using automatic load change was simulated reducing the plant load from 100 to 70 percent. This study is used as an example to evaluate the applicability of the proposed control concept to regular plant operation. In-and outputs of the proposed control concept.

Figure 11:
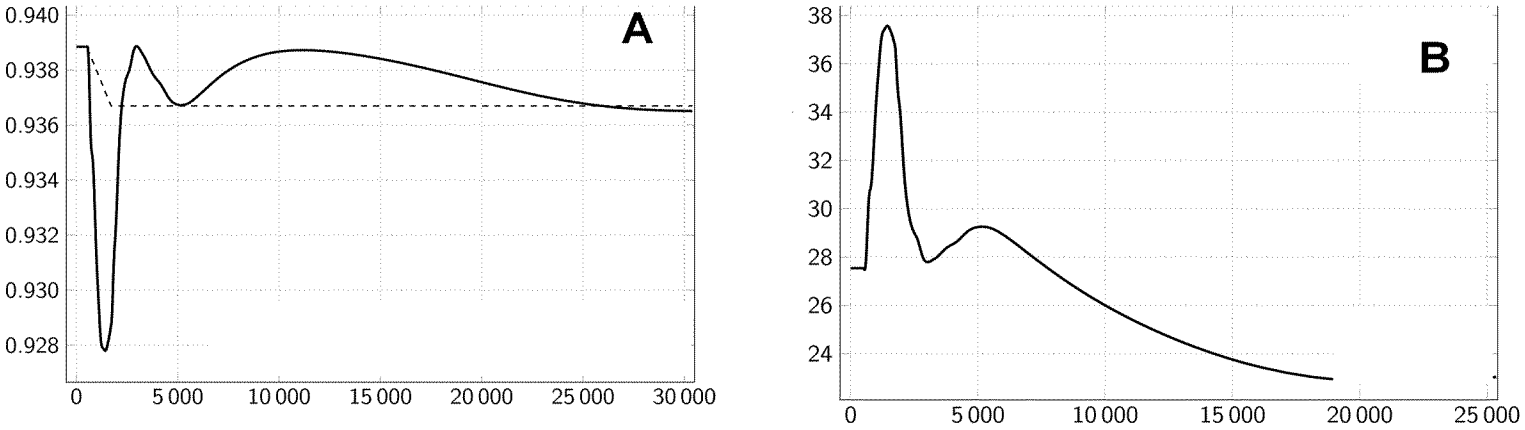

FIG. 11 shows the required set point changes for the proposed control loop (oxygen content in feed to argon removal unit) for the part load case in diagram A expressed as mole fraction and the waste argon flow in diagram B expressed in moles per second. The part load value for the oxygen content is pre-calculated in an additional steady-state simulation. The set point change is linear in nature (state-of-the-art automatic load change). The black, dashed line in diagram A represents the set point change whereas the solid line is the actual graph of the oxygen content. The applied control is able to correct the drop in the oxygen content, which is caused by the load change, very quickly. Afterwards, the graph of the oxygen content converges to its desired part load set point. The manipulated value of the proposed controller, the waste argon flow, is shown in diagram B of FIG. 11. The graph of the waste argon flow confirms an explicit correlation of these two quantities, emphasizing the reliable controllability using the proposed control concept.

Figure 12:
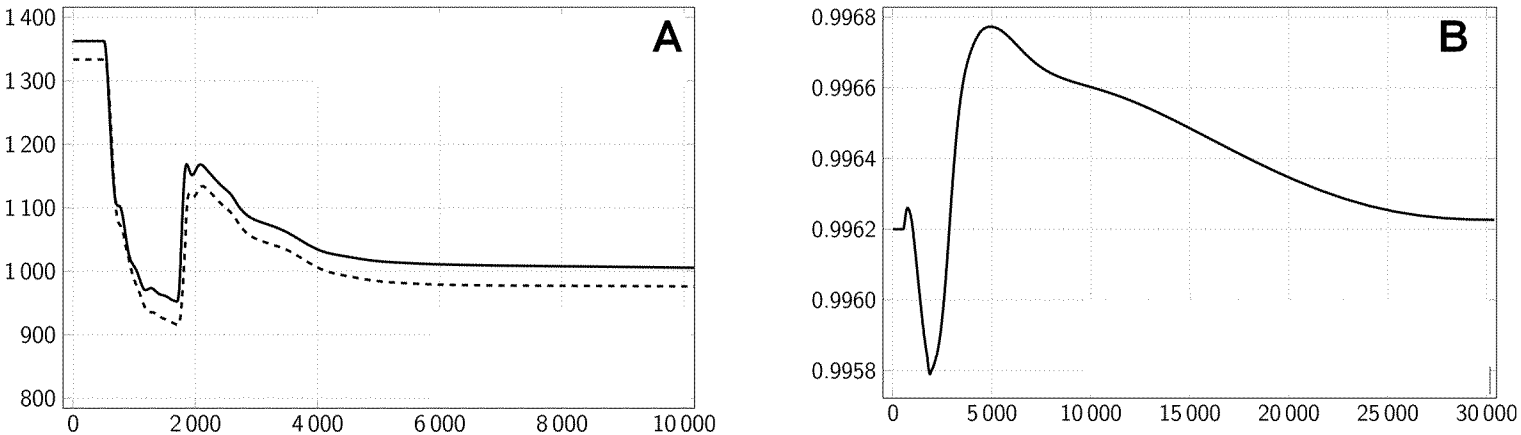

In FIG. 12, relevant aspects of the plant response are illustrated. In diagram A, the outgoing vapor (top) and liquid (bottom) flows of the uppermost theoretical tray of the argon removal unit are visualized. Diagram B depicts the oxygen molar fraction of the internally compressed oxygen product.

The oxygen content of the internally compressed oxygen product is shown in diagram B of FIG. 12. The graph of the product purity is similar to the oxygen content in the feed gas to the argon removal unit (see FIG. 11). This is due to the fact that the changes in the oxygen content are visible in the feed gas to the argon removal unit first. Thus, the proposed control concept is additionally beneficial for the adherence of the internally compressed oxygen product purity constraints. Due to the applied control the decrease of product purity remains very small. The dynamic simulation studies show that the proposed control concept allows for the reliable reduction of plant load from 100 to 70% using automatic load change with a higher than state-of-the-art load change rate (1 percent per minute). A new stable plant state is established approximately 1 hour after the setpoint changes of the end of the automatic load change. Furthermore, the oxygen content of the feed gas stream to the argon removal unit is an early indication of the behaviors of the internally compressed oxygen product. Thus, controlling this oxygen content is additionally beneficial for plant operations.

To sum it up, the presented case studies revealed that the proposed control concept is reliable to react on plant disturbances as well as is applicable for state-of-the-art load change procedures. The results of dynamic simulations shall be considered in design, particularly regarding pipe and valve sizing for the waste argon stream. The proposed control concept has a lower complexity (one control loop instead of two), requires a smaller volume of the crude argon condenser (10 to 15 percent less) and allows for the omission of large liquid control valve (liquid flow is ca. 25% of the process air flow).

The invention claimed is:

1. A cryogenic air rectification system comprising a high pressure column, a low pressure column and an argon removal unit coupled to a condenser evaporator, wherein the system is configured to pass gas from a position above an oxygen section of the low pressure column as an argon removal feed gas to a lower region of the argon removal unit, the system is configured to condense gas from an upper region of the argon removal unit in the condenser evaporator to form a condensate, the system is configured to pass further gas from the upper region of the argon removal unit out of the system, the system is configured to pass at least a part of the condensate as a reflux to the upper region of the argon removal unit, the system comprises a control unit configured to control an oxygen content of the argon removal feed gas as a controlled variable using a flow of the further gas from the upper region of the argon removal unit being passed out of the system as a manipulated variable on the basis of an oxygen content determined in the argon removal feed gas using a feedback control structure, the condenser evaporator is configured to at least partly evaporate a coolant forming an evaporated gas, and the system is configured to pass the evaporated gas, or a part thereof, uncontrolledly into the low pressure column.

2. The system according to claim 1, wherein the feedback control structure is a cascade control structure including an analysis controller as a primary controller and a flow controller or hand controller as a second controller.

3. The system according to claim 2, wherein the primary controller is configured to control the oxygen content of the argon removal feed gas as the controlled variable and wherein the secondary controller is configured to adjust the flow of further gas from the upper region of the argon removal unit being passed out of the system using a flow set point for the secondary controller as the manipulated value.

4. The system according to claim 3, wherein the control unit is adapted to perform a trim control using including a ramping of the flow set point of the flow controller or including a ramping of a valve stroke of the hand controller.

5. The system according to claim 1, wherein the low pressure column comprises a lower column region, an intermediate column region arranged above the lower column region, and an upper column region arranged above the intermediate column region, the lower column region including the oxygen section and the intermediate column region including a rectification section of the argon removal unit.

6. The system according to claim 5, wherein the lower region of the argon removal unit comprises a bottom open with respect to an upper region of the oxygen section to allow an entry of a part of a gas flow raising in the oxygen section as the argon removal feed gas.

7. The system according to claim 6, wherein the rectification section of the argon removal unit is at least in part arranged in a common space with an argon section of the low pressure column which comprises a bottom open with respect to the upper region of the oxygen section to allow an entry of a further part of the gas flow raising in the oxygen section.

8. The system according to claim 5, wherein the condenser evaporator is arranged above the rectification section of the argon removal unit in the intermediate column region.

9. The system according to claim 8, wherein the system is configured to pass the evaporated gas, or the part thereof, into the low pressure column via releasing the evaporated gas, or the part thereof into the intermediate column region.

10. The system according to claim 5, wherein the system is configured to pass the evaporated gas, or the part thereof, into the low pressure column via releasing the evaporated gas, or the part thereof into the intermediate column region.

11. The system according to claim 1, wherein the condenser evaporator is arranged above the argon removal column to form a rectification unit arranged besides the low pressure column and the system is configured to pass the evaporated gas, or the part thereof passed uncontrolledly into the low pressure column into the low pressure column via a tubing ending at a feed position into the low pressure column.

12. The system according to claim 1, wherein the condenser evaporator is a forced-flow condenser evaporator.

13. The system according to claim 1, wherein the condenser evaporator is configured to at least partly evaporate, as the coolant, a liquid collected from the intermediate column region.

14. The system according to claim 13, wherein condenser evaporator is configured to at least partly evaporate, as the coolant, a liquid collected in a lower region of the high pressure column.

15. An air separation unit adapted to cryogenically separate feed air, wherein the air separation unit comprises a system according to claim 1.

16. The system according to claim 1, wherein condenser evaporator is configured to at least partly evaporate, as the coolant, a liquid collected in a lower region of the high pressure column.

17. A control unit configured to control an air rectification system, the air rectification system comprising a high a-pressure column, a low pressure column and an argon removal unit coupled to a condenser evaporator, wherein the system is configured to pass gas from a position above an oxygen section of the low pressure column as an argon removal feed gas to a lower region of the argon removal unit, the system is configured to condense gas from an upper region of the argon removal unit in the condenser evaporator to form a condensate, the system is configured to pass further gas from the upper region of the argon removal unit out of the system, the system is configured to pass at least a part of the condensate as a reflux to the upper region of the argon removal unit, the control unit is configured to control an oxygen content of the argon removal feed gas as a controlled variable using a flow of the further gas from the upper region of the argon removal unit being passed out of the system as a manipulated variable on the basis of an oxygen content determined in the argon removal feed gas using a feedback control structure the condenser evaporator is configured to at least partly evaporate a coolant forming an evaporated gas, and the system is configured to pass the evaporated gas, or a part thereof, uncontrolledly into the low pressure column.

18. A method for cryogenically separating feed air using an air rectification system comprising a high a-pressure column, a low pressure column and an argon removal unit coupled to a condenser evaporator, wherein gas from a position above an oxygen section of the low pressure column is passed to a lower region of the argon removal unit as an argon removal feed gas, gas from an upper region of the argon removal unit is condensed in the condenser evaporator to form a condensate, further gas from the upper region of the argon removal unit is passed out of the system, at least a part of the condensate is passed as a reflux to the upper region of the argon removal unit, a control unit controlling an oxygen content of the argon removal feed gas as a controlled variable using a flow of the further gas from the upper region of the argon removal unit being passed out of the system as a manipulated variable on the basis of an oxygen content determined in the argon removal feed gas using a feedback control structure is used a coolant is at least partly evaporated in the condenser evaporator, forming an evaporated gas, and the evaporated gas, or a part thereof, is passed uncontrolledly into the low pressure column.

19. The method according to claim 18, wherein a cryogenic air rectification system comprising a high pressure column, a low pressure column and an argon removal unit coupled to a condenser evaporator, wherein the system is configured to pass gas from a position above an oxygen section of the low pressure column as an argon removal feed gas to a lower region of the argon removal unit, the system is configured to condense gas from an upper region of the argon removal unit in the condenser evaporator to form a condensate, the system is configured to pass further gas from the upper region of the argon removal unit out of the system, the system is configured to pass at least a part of the condensate as a reflux to the upper region of the argon removal unit, the system comprises a control unit configured to control an oxygen content of the argon removal feed gas as a controlled variable using a flow of the further gas from the upper region of the argon removal unit being passed out of the system as a manipulated variable on the basis of a oxygen content determined in the argon removal feed gas using a feedback control structure, the condenser evaporator is configured to at least partly evaporate a coolant forming an evaporated gas, and the system is configured to pass the evaporated gas, or a part thereof, uncontrolledly into the low pressure column, is used.

* * * * *